United States Patent [19]

Levy

[11] Patent Number: 4,583,957

[45] Date of Patent: Apr. 22, 1986

[54] PNEUMATICALLY-OPERATED ROBOTIC TOY

[76] Inventor: Henry A. Levy, 402 Foster Ave., Brooklyn, N.Y. 11230

[21] Appl. No.: 587,696

[22] Filed: Mar. 8, 1984

[51] Int. Cl.[4] ..... A63H 3/06

[52] U.S. Cl. ..... 446/177; 446/183; 446/390

[58] Field of Search ..... 446/198, 197, 190, 199, 446/185, 183, 184, 180, 177, 176, 390

[56] References Cited

U.S. PATENT DOCUMENTS

| | | | |
|---|---|---|---|
| 536,512 | 3/1895 | Crossley et al. | 446/198 |
| 691,266 | 1/1902 | Hill | 446/180 |
| 2,041,737 | 5/1936 | Beal | 446/220 |
| 2,047,377 | 7/1936 | Liwschutz | 446/190 X |
| 2,738,611 | 3/1956 | Miller | 446/198 X |
| 3,141,261 | 7/1964 | Mirando | 446/185 |
| 3,153,881 | 10/1964 | Baulard-Cogan . | |
| 3,346,989 | 10/1967 | Ryan . | |
| 3,503,152 | 3/1970 | Aoki et al. | 446/199 X |
| 3,600,845 | 8/1971 | Mendigal . | |
| 3,695,148 | 10/1972 | Baginski et al. | 446/197 X |
| 3,881,275 | 5/1975 | Baulard-Cogan . | |
| 3,996,695 | 12/1976 | Sapkus et al. . | |
| 4,057,928 | 11/1977 | Terzian . | |
| 4,067,138 | 1/1978 | Cederholm et al. . | |
| 4,156,985 | 6/1979 | Viner | 446/183 |
| 4,240,224 | 12/1980 | Katzman et al. . | |
| 4,259,806 | 4/1981 | Troll . | |
| 4,261,134 | 4/1981 | Terzian . | |
| 4,271,744 | 6/1981 | Kulesza . | |

OTHER PUBLICATIONS

"Pneumatic Grippers," *Machine Design*, a Penton/IPC Publication, Nov. 25, 1982, by Gernot Neubauer, pp. 69–71.

*Primary Examiner*—Mickey Yu

*Attorney, Agent, or Firm*—Lilling & Greenspan

[57] ABSTRACT

The pneumatically-operated robotic toy includes an internal bellows or air pump which forces pressurized air to flow from the internal air pump or bellows through passageways into hollow arms of the robot. Inasmuch as the arms of the robot include bellows, this flow of air causes the arms to move from an open to a closed position, or vice versa. Air pressure holding joints are provided to permit several degrees of freedom of movement. Alternatively, the internal bellows may be positioned in the head of the robot, and movement of the head will cause the arms to move up and down. A flexible rotatable suction cup base may be provided. A second internal bellows may be provided, either in the torso or in the head, for activation of the suction cup base of the robotic toy.

16 Claims, 13 Drawing Figures

PNEUMATICALLY-OPERATED ROBOTIC TOY

BACKGROUND OF THE INVENTION

This invention relates to the field of space-age toys, and specifically to space-age robot toys with controllable movable limbs with multiple degrees of freedom of movement. Because of the recent success of several science-fiction movies, toys based on these space adventures have become very popular among children. Toys in the shape of robots, androids and other creatures have been exceptionally popular because of the proliferation of such characters in recent space-adventure movies.

There is, therefore, a need for robot toys to fulfill the imagination of children. Because of the sophistication of children, it is necessary for these robot toys to be very realistic and for them to be capable of many degrees of freedom of movement. These toys should also be conducive to having fun, and should be constructive play toys to help develop the psychomotor and cognitive abilities of a child.

Thus far, although there exists many inexpensive robotic toys which have multiple degrees of freedom in their movement, they are usually poseable and must be operated with one or two hands. The advantage of this invention is that it is an inexpensive toy robot with multiple degrees of freedom, and it can be independently controlled by a self-contained air pump. Further, it can be used for picking up, grasping, holding, releasing, turning, bending down and manipulating toy objects, while still being easily controlled by one hand of a child.

SUMMARY OF THE INVENTION

There is, therefore, a need in the marketplace for a simple robot toy that is capable of limited movement and which is simple in design and construction. Such a toy has been provided by the PNEUMATICALLY-OPERATED ROBOTIC TOY which is capable of multiple degrees of freedom of arm and body movement in a relatively simple manner. The PNEUMATICALLY-OPERATED ROBOTIC TOY is provided with an internal bellows or air pump which may be activated by depressing the torso of the robot. This causes pressurized air to flow from the air pump or bellows through passageways into hollow arms of the robot. Because the arms of the robot include bellows, this causes the arms to move from an open to a closed position, or vice versa. Air pressure holding joints are provided to permit several degrees of freedom of movement. A flexible rotatable suction cup base may be provided, which enables the robot to bend over. This detachable suction cup base provides grip release action and several degrees of freedom of rotation, bending over and up and down motion.

BRIEF DESCRIPTION OF THE INVENTION

DETAILED DESCRIPTION OF THE INVENTION

Figure 6:
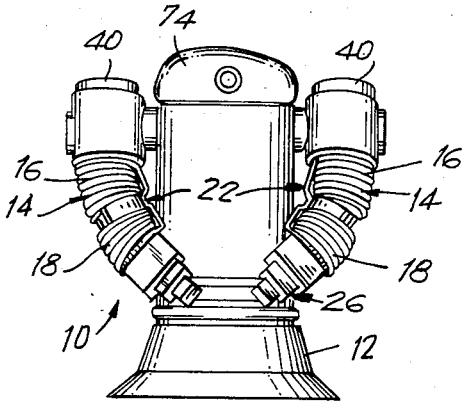
FIG. 6 is a front view of the PNEUMATICALLY-OPERATED ROBOTIC TOY.

As shown in FIG. 6, the PNEUMATICALLY-OPERATED ROBOTIC TOY 10 may have a simple exterior appearance and it can have almost any appearance, provided that it gives the appearance of a space-age robot. The particular type of surface ornamentation may vary, depending on the appearance that is desired. The size and shape of the head can be varied in any desirable manner. In the embodiment shown in the drawings, the robot is supported by a bottom support 12 which is essentially conical in shape, and is free to rotate. To simplify movement of the toy over playing surfaces, rollers or wheels may be placed on the bottom surface (or side surfaces) of the bottom support 12. Alternatively, it is possible to substitute legs for the robot instead of the bottom support 12. With the exception of the arms and torso of the robot, which will be hereinafter described, the robot may be constructed in any manner that is considered desirable.

The PNEUMATICALLY-OPERATED ROBOTIC TOY may be made from any material which is suitable for use by children. This necessarily includes metals, plastic, etc. Generally speaking, however, the robot will best function when the arms are made from a plastic or rubber material, which will have sufficient elasticity to permit movement of the arms.

Extending on both the left and the right side of the robot from the upper portion of the torso are movable arms 14. It will be observed that, in most embodiments, the left and right arms would be made in the same manner, but in some applications it may be desirable to construct the arms differently. For purposes of describing the invention, only one arm will be described, but it will be appreciated that the description is applicable to both arms.

The arms should preferably include upper and lower bellows 16 and 18 which are separated by a smooth exterior area 20 in the vicinity of the elbow. The corrugated appearance of the bellows will give a space-age appearance to the arms of the robot in addition to serving as a pneumatic device, as will be hereinafter explained. In some embodiments, where less movement of the arms are desired, it may be desirable to form the arms of a single bellows. In such a situation, the movement of the arms would operate in precisely the same manner, but the movement would be restricted accordingly.

Figure 8:
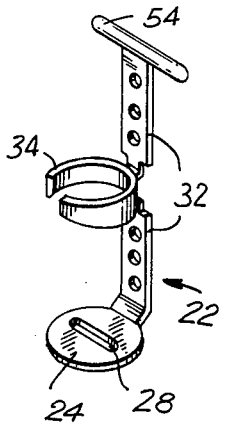
FIG. 8 is a perspective view of the arm stiffening member.

To hold the arm in position, an arm stiffening member 22 may be used, and such a stiffening member is illustrated in FIG. 8. A bottom plate 24 of the arm stiffening member 22 is essentially round in shape and it is placed in juxtaposition to the lowermost or bottom portion of the respective arm 14. A bolt, screw or other fastening means 30 passes through an opening 28 in the bottom plate 24 to secure a hand portion 26 to the lowermost portion of the arm 14 (see FIG. 2). As mentioned, the bottom plate 24 is perpendicular to the axis of the arm and is flush with the bottommost end of the arm. The hand of the PNEUMATICALLY-OPERATED ROBOTIC TOY may be of any suitable configuration. It may have the appearance of a claw or gripper, as are commonly associated with robots, or it can even have the appearance of a human hand.

Extending perpendicularly from one side of the bottom plate 24 is a connecting plate 32. The connecting plate 32 may be continuous for the entire height or length of the arm stiffening member 22, or it can be made of two separate plates as shown in FIG. 8. Approximately midway along the connecting plate 32 is a support clip 34. This support clip 34 extends perpendicular to the connecting plate 32, and is approximately parallel to the bottom plate 24. The support clip extends from the connecting plate 32 as shown in FIG. 8. The support clip 34 snaps or clips around the elbow region 20 of the arm 14, in the vicinity between the upper and lower bellows 16 and 18 that constitute the arm 14 (see FIG. 2). This causes the bottom portion of the connecting plate 32 to be in juxtaposition with the outer surface of the lower bellows 18, and for the upper portion of the connecting plate 32 to be in juxtaposition with the outer portion of the upper bellows 16 (see FIG. 2). The effect of the connecting plate 32 is to keep the arm 14 in an appropriate position. It will be pointed out that the PNEUMATICALLY-OPERATED ROBOTIC TOY will operate according to the teachings of this invention just as well without the arm stiffening member 22. The purposes of this member are to give more rigidity and leverage to the arm 14, but this is not necessary if it is desired for the arm to have a less rigid appearance or if the arm is made of a sufficiently rigid material.

One of the effects of the arm stiffening member is to restrict the expansion of the bellows that constitute the arms 14, and to cause them to bow or arch outwardly from the arm stiffening member, thereby creating a bow-shaped expanded bellows pivoting at the shoulder. The hand 26 of the thus created arm will therefore move in the direction of the arm stiffening member with a greater force and distance of movement, than if it were continuously attached to, or built into, a preset specially molded bellows. When the arm stiffening member is attached to the elbow portion of the arm, the arching upper arm and arching lower arm will curl the entire arm. This will also cause the arm to pivot at the shoulder. It can be appreciated that the arm stiffening member may not be attached to the elbow portion of the arm, but this would cause the arm to have a different type of motion, which is less appealing to the child and less realistic.

If the arm stiffening member is made so that it can be easily separated or removed from the arm, the arm can extend along its length to produce a punching or reaching action, which is just another type of movement that may be desirable to make the toy more appealing to children.

Figure 1:
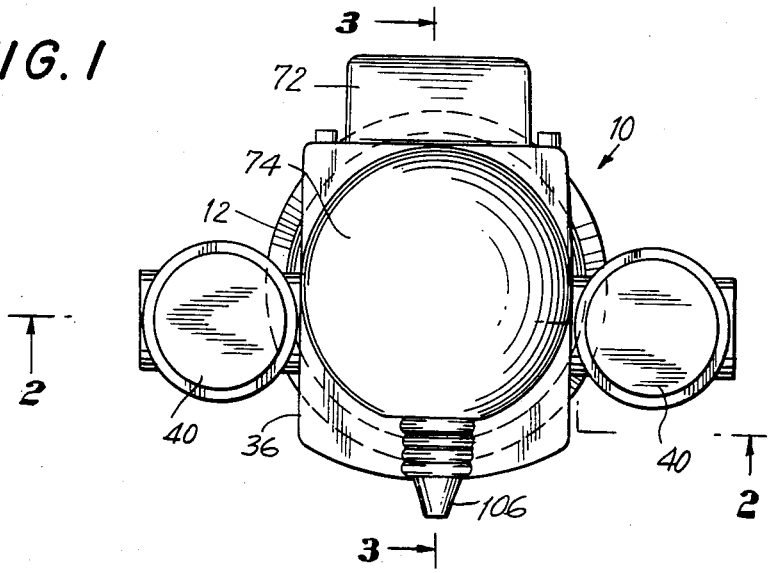
FIG. 1 is a top plan view of the PNEUMATICALLY-OPERATED ROBOTIC TOY.
Figure 2:
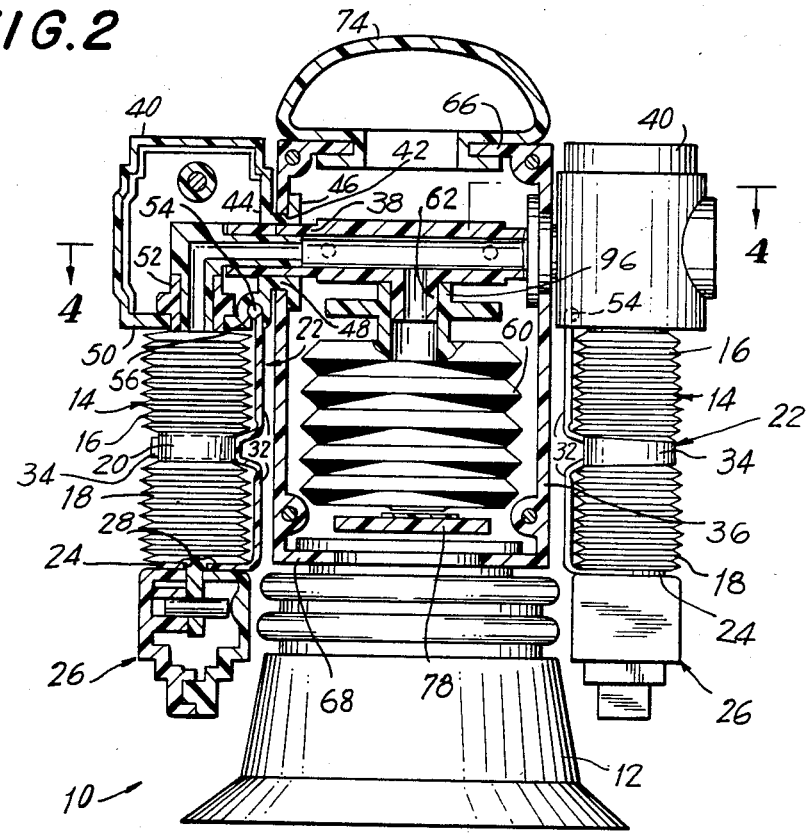
FIG. 2 is a front cross-sectional view of the PNEUMATICALLY-OPERATED ROBOTIC TOY taken along the line 2—2 of FIG. 1.

Extending from an upper portion of the torso 36 of the PNEUMATICALLY-OPERATED ROBOTIC TOY is a hollow shaft 38. This hollow shaft 38 extends across the entire upper portion of the torso 36 and extends out on both the right and left side of the PNEUMATICALLY-OPERATED ROBOTIC TOY. Rotatably secured on each outer end of the hollow shaft 38 is a shoulder member 40. Each shoulder 40 has an inner portion which is rotatably mounted in an opening 42 in the upper portion of the torso 36. The inner portion of the shoulder 40 consists of an end piece 44 and a rotating piece 46, which is of smaller diameter than the end piece 44. Connecting the end piece 44 and the rotating piece 46 is a connecting stub 48. As shown in FIG. 2, the end piece 44, the rotating piece 46 and the connecting stub 48 are made integral with each other and with the shoulder 40 as a whole.

Within the shoulder 40, a hollow extension 52 extends perpendicularly from the hollow shaft 38. The extension 52 extends downward from the hollow shaft 38 up to and through a bottom portion 50 of the shoulder 40. The distill end of the extension 52 is connected by any suitable means with an opening in the upper bellows 16 (see FIG. 2).

At the top end of the arm stiffening member 22 is a pivot pin 54. The pivot pin 54 is fitted into an elongate slot 56 in the bottom wall 50 of the shoulder 40.

With the aforementioned arrangement, the arm 14 and shoulder 40 of the PNEUMATICALLY-OPERATED ROBOTIC TOY is capable of a great deal of movement. For example, the shoulder and arm is free to rotate about the hollow shaft 38. In other words, this permits rotational motion of the arm and shoulder in a plane that is parallel to the vertical axis of the PNEUMATICALLY-OPERATED ROBOTIC TOY. The pivot pin 54 permits the arm 14 to pivot about the lower portion of the shoulder 40, as will be hereinafter described.

Figure 9:
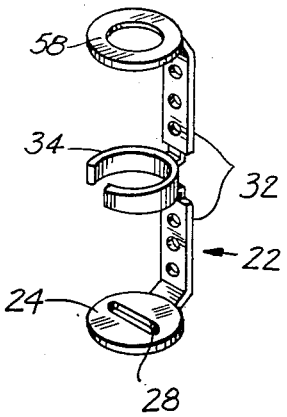
FIG. 9 is a perspective view of an alternate embodiment of the arm stiffening member.
Figure 7:
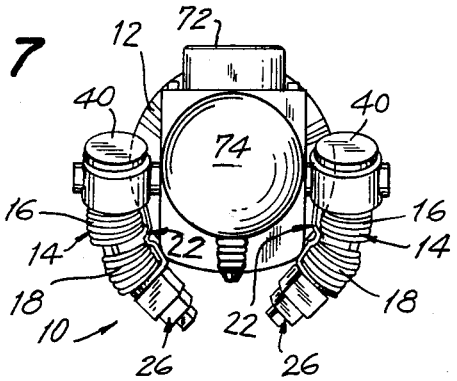
FIG. 7 is a top view of the PNEUMATICALLY-OPERATED ROBOTIC TOY.

In FIG. 9, an alternative arm stiffening member is shown. This arm stiffening member includes an upper support plate 58 which would be positioned between the upper bellows 16 and the bottom 50 of the shoulder 40, and would serve to fasten the arm 14 to the shoulder 40. This type of connection would permit rotation of the arm about its axis. Thus it is apparent that either of the arm stiffening members (as shown in either of FIGS. 8 or 9) can be used, depending on the degree of movement that is desired for the arm 14.

Figure 3:
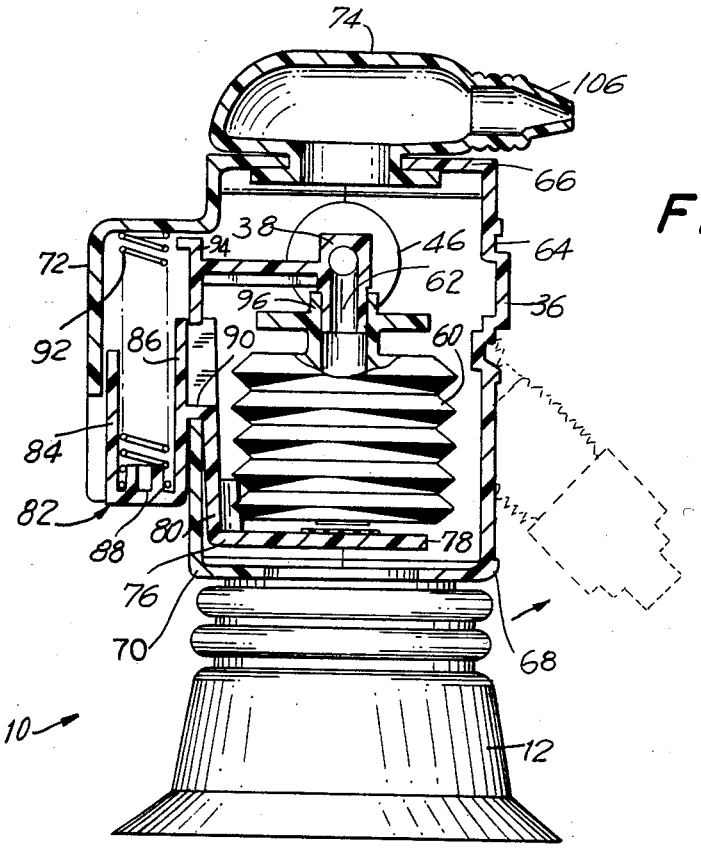
FIG. 3 is a right side cross-sectional view of the PNEUMATICALLY-OPERATED ROBOTIC TOY taken along the line 3—3 of FIG. 1.
Figure 4:
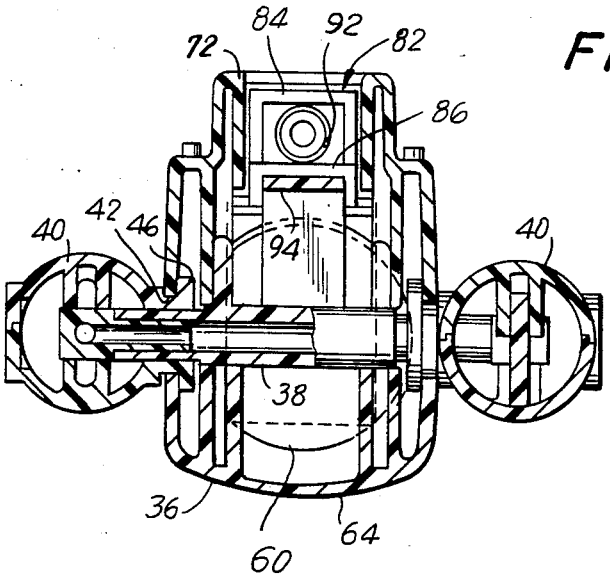
FIG. 4 is a partial top cross-sectional view, showing the manner in which the arms are connected to the body of the PNEUMATICALLY-OPERATED ROBOTIC TOY.

Resting within the torso 36 of the PNEUMATICALLY-OPERATED ROBOTIC TOY is an air pump. In the preferred embodiment of the invention, the air pump is in the form of a bellows 60, but any type of appropriate air pump may be used. An appropriate conduit 62 is used to connect the interior portion of the air pump or bellows 60 with the hollow shaft 38. As shown in FIG. 3, the bellows 60 is arranged vertically within the torso 36.

The torso 36 includes a front wall 64, a top wall 66, a bottom wall 68, a lower rear wall 70 which extends only partially up the torso, and an upper rear wall which is in the shape of a handle 72 (see FIG. 3). The bottom wall 68 is attached to the bottom support 12 of the PNEUMATICALLY-OPERATED ROBOTIC TOY in any suitable manner, and the top wall 66 is attached to a head portion 74 of the PNEUMATICALLY-OPERATED ROBOTIC TOY in any suitable manner. As is shown in FIG. 3, the head 74 is mounted on the top wall 66 of the torso 36 in such a manner as to permit rotation of the head about the vertical axis of the PNEUMATICALLY-OPERATED ROBOTIC TOY. As explained previously, the head 74 can be of any desirable shape, dimension, and appearance. By providing suitable openings in the torso, the head and arms will be able to rotate about the vertical axis of a cylindrical robot, thereby providing additional degrees of freedom of movement.

Within the interior portion of the torso 36, the bellows 60 rests on a bellows support plate 76. The bellows support plate 76 is substantially in an L-shape and the lower portion of the bellows rests on a horizontal leg 78 of the support plate 76. A vertical leg 80 extends substantially perpendicular to the horizontal plate 78 and is approximately parallel to the lower rear wall 70 of the torso 36. The bellows support plate 76 is made integral with a gripping portion 82 that extends outside of the torso 36. The gripping portion 82 is essentially an open rectangle, with two long sides 84 and 86 which are connected by a small side 88. Extending from the long side 86 is a stub 90 which is connected to an upper portion of the vertical leg 80 of the bellows support plate 76. A spring 92 extends from the small side 88 of the gripping portion 82, between the sides 84 and 86 of the gripping portion 82, and up against the inside top portion of the handle 72. The spring in its normal position maintains the bellows support plate 76 and the gripping portion 82 in the position shown in FIG. 3, which will be referred to as the non-operating position of the PNEUMATICALLY-OPERATED ROBOTIC TOY. Extending horizontally from the conduit 62 is a limit stop 94 that restricts the upward motion of the long side 86 of the gripping portion 82, and consequently limits the upward movement of the bellows support plate 76. The conduit 62 also includes a bellows depression portion 96. As can be appreciated, the limit stop 94 and the bellows depression portion 96 could be attached as well to the hollow shaft 38 as to the conduit 62. The shapes of these elements can be of any appropriate shape, so long as they fulfill the purposes intended for these elements.

Figure 5:
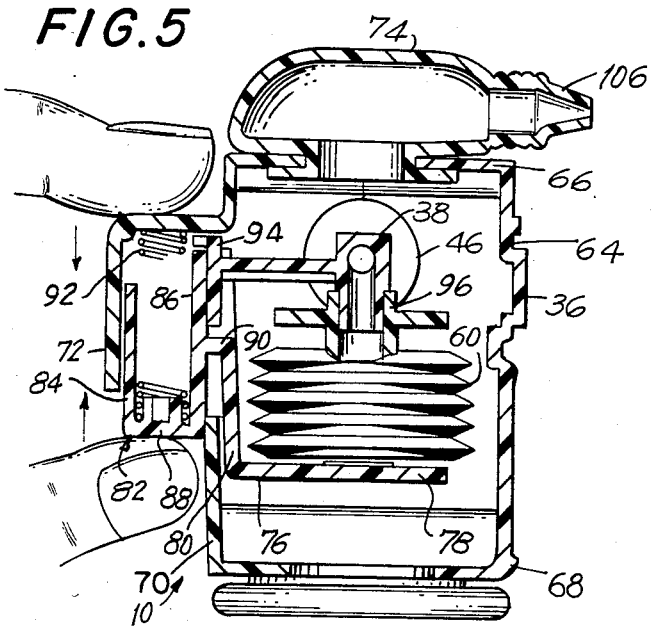
FIG. 5 is a right side cross-sectional view, partially broken away, showing the manner in which the internal bellows is activated.

The child using the PNEUMATICALLY-OPERATED ROBOTIC TOY can use it as he uses any robot toy. The robot can move along a playing surface by means of wheels or other rollers positioned on the bottom surface of the bottom support 12. The child may also be free to rotate the arms 14, as previously described. In order to cause greater motion of the arms 14, the air pump within the torso can be activated. To accomplish this, as shown in FIG. 5, the child grips the upper portion of the handle 72 and the short side 88 of the gripping portion 82, and uses his or her fingers to push them together. This causes upward motion of the horizontal legs 78 of the bellows support plate 76, as the bellows support plate 76 is made integral with the gripping portion 82. Since the bellows depression portion 96 is fixed stationary on either the conduit 62 or the hollow shaft 38, this upward motion of the bellows support plate causes compression of the bellows 60. Air is necessarily forced out from the bellows, through the conduit 62 and the hollow shaft 38, and into the bellows 16 and 18 of the arms 14. This causes expansion of the bellows 16 and 18 in the arms 14, and causes the arms to move from an open position to a closed position. The limit stop 94 serves to restrict the upper motion of the gripping portion 82 in order to prevent the bellows 60 from being compressed too far. As soon as the child releases the handle 72 and the gripping portion 82, the spring 92 returns the bellows support plate 76 to its normal non-operating position, and the bellows is no longer compressed. As there is no longer any air being forced through the bellows 16 and 18 of the arms 14, the arms return to their normal open position.

As can be appreciated, the arms can be positioned so that they are normally in an open position and activation of the air pump causes the arms to move to a closed position. It is equally possible to have the arms in a normal closed position, so that the forced air through the bellows will cause the arms to move to an open position. Either possibility may be used with the PNEUMATICALLY-OPERATED ROBOTIC TOY of the invention.

As can be appreciated, the spring and the limit stop can be dispensed with in some embodiments. For example, the limit stop 94 can be eliminated, because the motion of the bellows support plate 76 will necessarily be restricted by the long side 86 striking against the inner top surface of the handle 72. Further, the natural elasticity of the bellows 60 will cause the bellows to return to its normal position when the pressure is released, and this may be sufficient to obviate the need for the spring 92. Thus, in some embodiments, it may be desirable to omit either or both of the limit stop 94 and/or the spring 92.

In still other embodiments of the invention, standard air pressure reed noise-makers can be placed within the hollow air conduits. This would provide sounds to appropriate parts of the robot when there is a flow of air through these hollow air conduits. This may be desirable in some embodiments to make the PNEUMATICALLY-OPERATED ROBOTIC TOY more lifelike and more interesting to children.

In still other embodiments of the invention, it may be desirable to entirely omit the gripping portion 82 and the handle 72. In such an embodiment, the torso would be made into halves, a top portion and a lower portion. The lower portion would have a slightly smaller outside diameter and the bellows would rest within the lower portion. The upper portion torso would have a slightly larger diameter and would slightly overlap the lower portion of the torso. By depressing the upper portion of the torso, the lower portion of the torso would be telescoped into and out of the upper torso. This would necessarily cause compression of the bellows in the manner previously described. Such an arrangement may be suitable where the external handle and gripping portion are not desirable.

In some embodiments, the handle 72 and the gripping portion 82 can be fashioned to give the appearance of a space backpack. As can be appreciated, the PNEUMATICALLY-OPERATED ROBOTIC TOY can be painted or have decals placed on it in order to give any appearance that is desirable.

Figure 10:
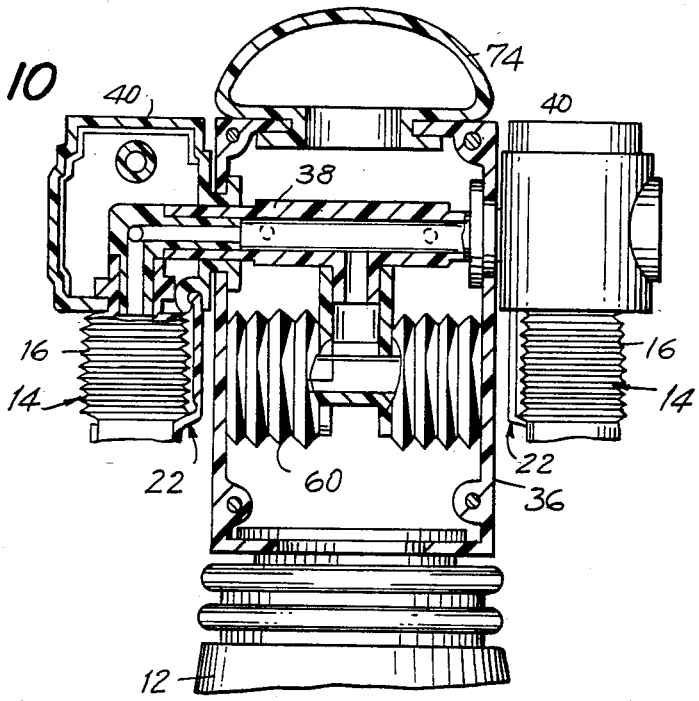
FIG. 10 is a right side cross-sectional view, showing an alternate arrangement of the PNEUMATICALLY-OPERATED ROBOTIC TOY wherein the bellows is positioned horizontally within the torso of the toy.

In another alternate embodiment of the invention (see FIG. 10), the air pump or bellows 60 may be arranged horizontally within the torso 36. In such an arrangement, the torso would be made of a relatively soft and elastic material. In order to activate the air pump, the child would press the sides of the torso together to compress the bellows. In all other respects, this version of the invention would work in the way previously described.

In still another embodiment of the invention (see FIG. 11), the bellows 98 could be positioned either horizontally or vertically within the head 74 of the PNEUMATICALLY-OPERATED ROBOTIC TOY. By depressing the head in a suitable direction, the bellows could be compressed in order to force air through the system in the manner previously described.

Figure 11:
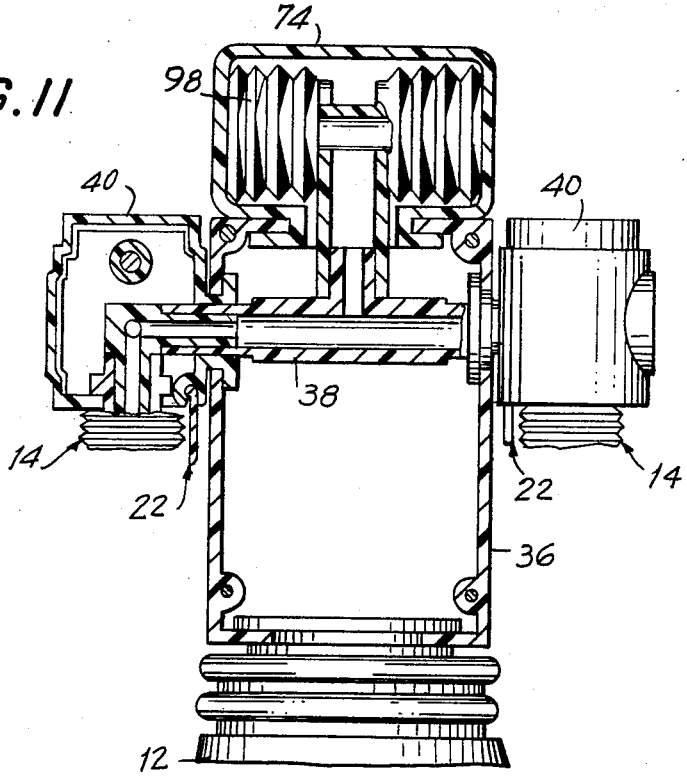
FIG. 11 is a cross-sectional view of the PNEUMATICALLY-OPERATED ROBOTIC TOY, showing an alternate embodiment of the invention wherein the bellows is positioned within the head of the PNEUMATICALLY-OPERATED ROBOTIC TOY.

It should be appreciated that in the embodiment shown in FIG. 11, since the bellows is located within the head of the PNEUMATICALLY-OPERATED ROBOTIC TOY, when the head is tilted forward or backwards, there will be a raising or lowering of the arms. This will provide still another degree of movement to the PNEUMATICALLY-OPERATED ROBOTIC TOY, and make it more enjoyable for children who are playing with it.

Figure 12:
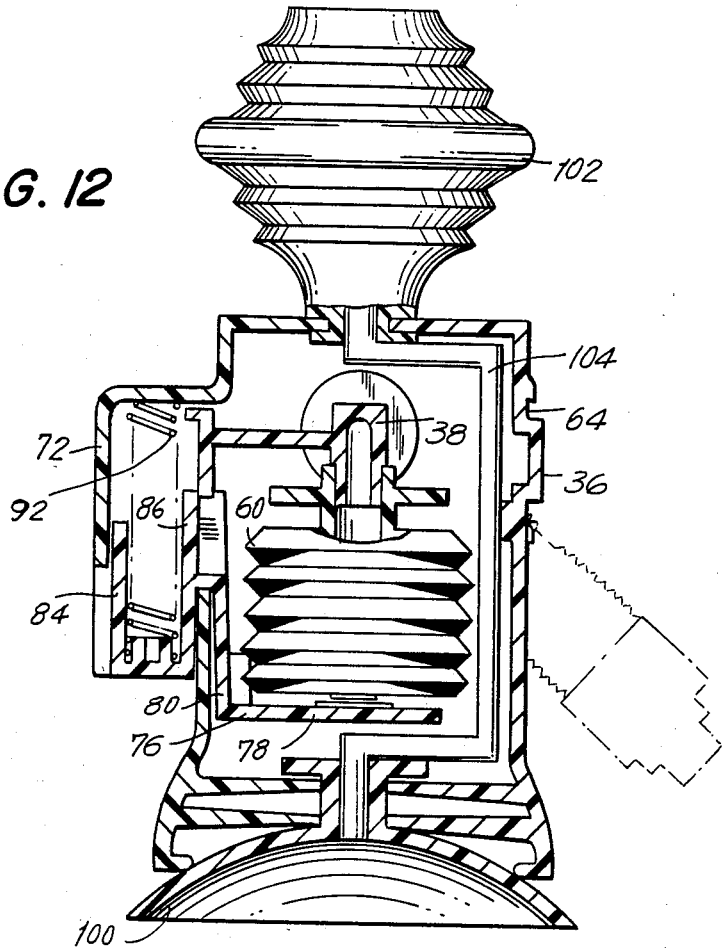
FIG. 12 is a right side elevational view of the PNEUMATICALLY-OPERATED ROBOTIC TOY, showing an alternate embodiment of the invention wherein the bottom support includes a suction cup and an additional bellows is included within the head of the PNEUMATICALLY-OPERATED ROBOTIC TOY.
Figure 13:
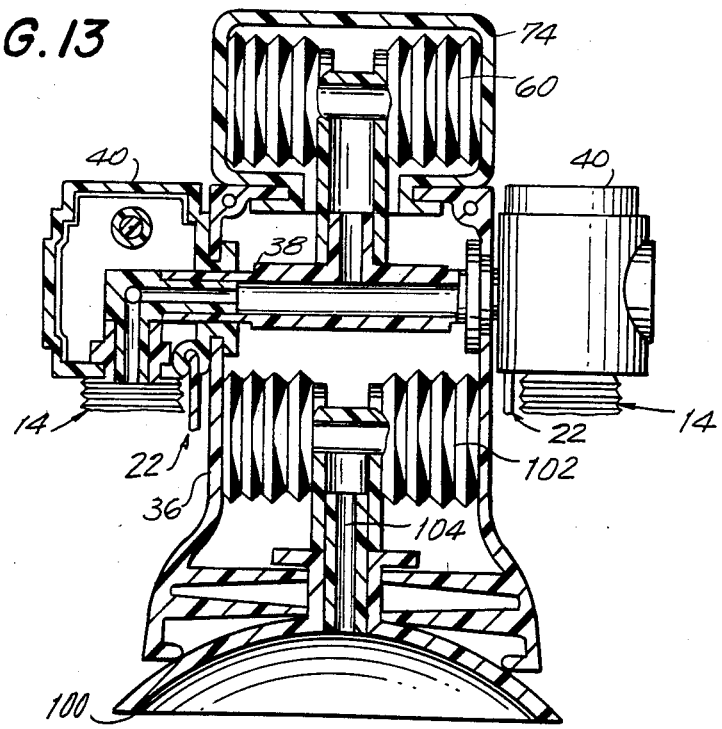
FIG. 13 shows a front cross-sectional view of the PNEUMATICALLY-OPERATED ROBOTIC TOY, showing an alternate embodiment of the invention wherein a bellows is positioned in the head to activate the arms of the PNEUMATICALLY-OPERATED ROBOTIC TOY and a bellows is positioned within the torso of the toy to operate a suction cup on the bottom support of the toy.

As shown in FIGS. 12 and 13, on the bottom support of the PNEUMATICALLY-OPERATED ROBOTIC TOY, a suction cup 100 may be provided. This suction cup would permit the child to use the PNEUMATICALLY-OPERATED ROBOTIC TOY to lift and release objects and to adhere the PNEUMATICALLY-OPERATED ROBOTIC TOY to surfaces, such as floors, walls, ceilings, etc. The suction cup is operated in any conventional manner and an additional bellows or air pump 102 is provided to activate the suction cup, along with conduit means 104 to connect the bellows and the suction cup.

In FIG. 12, the additional bellows 102 is provided within the head of the PNEUMATICALLY-OPERATED ROBOTIC TOY and a conduit 104 extends from the additional bellows to the suction cup 100. By compressing the head, the additional bellows is necessarily compressed, and air is forced through the conduit to activate the suction cup. In the embodiment shown in FIG. 13, the additional bellows 102 is provided within the torso. By pinching or compressing the sides of the torso together, the bellows is necessarily compressed. This forces air through the conduit 104 to the suction cup 100, and causes operation of the suction cup.

It is also observed that the pleats in the suction cup will flex, thereby permitting the robot to bend over in each direction. This provides still another degree to movement to the PNEUMATICALLY-OPERATED ROBOTIC TOY, and makes it more realistic.

In still another embodiment of the invention (see FIG. 3), the head 74 of the PNEUMATICALLY-OPERATED ROBOTIC TOY can be made hollow and have a squirt nozzle 106 affixed to it. The squirt nozzle of the head can be placed into a water reservoir, and the head depressed. This would necessarily cause the water to flow into the internal hollow chamber of the head, and to be stored therein. When the squirt nozzle is removed from the water reservoir and the head is no longer depressed, the hollow section of the head will be substantially filled with water. Then, the child can depress the head and shoot water through the squirt nozzle. This is another aspect of the invention which would make it more enjoyable for children to use when playing.

Therefore, by using only one hand, a child has a PNEUMATICALLY-OPERATED ROBOTIC TOY which can offer a great deal of pleasure. For example, the child can squeeze the body, in some manner, to activate a bellows and move the arms. In some embodiments, the child can simply activate a bellows to activate a suction cup on the bottom of the PNEUMATICALLY-OPERATED ROBOTIC TOY. In other examples, the child can depress the head of the PNEUMATICALLY-OPERATED ROBOTIC TOY to squirt water. As noted, the arms have a great degree of freedom of movement, and this offers additional enjoyment to the child. As can be appreciated, this toy offers much to the child, because of the extensive movements that the PNEUMATICALLY-OPERATED ROBOTIC TOY is capable of making.

I claim:

1. A PNEUMATICALLY-OPERATED ROBOTIC TOY comprising a housing; arms extending from said housing and including bellows means; air pump means located within said housing; conduit means providing fluid communication between said air pump means and said bellows means of said arms; and means for activating said air pump including handle means installed on an outer portion of said housing, air pump compression means positioned within said housing, and a gripping portion means interacting with said air compression means when said handle means and said gripping portion are forced together, wherein activation of said air pump means causes elongation of said bellows means and movement of said arms from a first to a second position.

2. A PNEUMATICALLY-OPERATED ROBOTIC TOY according to claim 1, wherein said means for activating said air pump further comprises resilient means retaining said air pump compression means in a position wherein said air pump is not activated.

3. A PNEUMATICALLY-OPERATED ROBOTIC TOY according to claim 1, wherein said means for activating said air pump further comprises limit stop means restricting operation of said air pump compression means.

4. A PNEUMATICALLY-OPERATED ROBOTIC TOY according to claim 2, wherein said means for activating said air pump further comprises limit stop means restricting operation of said air pump compression means.

5. A PNEUMATICALLY-OPERATED ROBOTIC TOY comprising a housing; arms extending from said housing and including bellows means; air pump means located within said housing; conduit means providing fluid communication between said air pump means and said bellows means of said arms; and means for activating said air pump including handle means installed on an outer portion of said housing, air pump compression means positioned within said housing, and a gripping portion means interacting with said air compression means when said handle means and said gripping portion are forced together, wherein activation of said air pump means causes elongation of said bellows means and movement of said arms from a first to a second position; suction cup means on a lower portion of said housing; a second air pump installed within said housing and activating said suction cup means; and conduit means for providing fluid communication between said second air pump and said suction cup means.

6. A PNEUMATICALLY-OPERATED ROBOTIC TOY according to claim 1, further comprising suction cup means on a lower portion of said housing; a second air pump installed within said housing and activating said suction cup means; and conduit means providing fluid communication between said second air pump and said suction cup means.

7. A PNEUMATICALLY-OPERATED ROBOTIC TOY according to claim 5, further comprising means for activating said second air pump.

8. A PNEUMATICALLY-OPERATED ROBOTIC TOY according to claim 6, further comprising means for activating said second air pump.

9. A PNEUMATICALLY-OPERATED ROBOTIC TOY according to claim 1 further comprising air pressure reed noise-makers positioned within said conduit means.

10. A PNEUMATICALLY-OPERATED ROBOTIC TOY according to claim 1, further comprising an arm-stiffening means affixed to said arms.

11. A PNEUMATICALLY-OPERATED ROBOTIC TOY according to claim 10, wherein said arm-stiffening means comprises a bottom plate affixed to a bottom portion of said arm; a connecting plate extending the length of the outer surface of said arm.

12. A PNEUMATICALLY-OPERATED ROBOTIC TOY according to claim 11, wherein the arm-stiffening member further comprises a pivot pin for pivotally attaching the arm stiffening member to said housing.

13. A PNEUMATICALLY-OPERATED ROBOTIC TOY according to claim 11, wherein the arm-stiffening member comprises an upper support plate positioned between the arm and said housing, and permitting rotational movement of said arm about its axis.

14. A PNEUMATICALLY-OPERATED ROBOTIC TOY comprising a housing; arms extending from said housing and including bellows means; air pump means located within said housing and communicating with said bellows means in said arms, wherein activation of said air pump means causes elongation of said bellows means and movement of said arms from a first to a second position; and arm-stiffening means affixed to said arms and including a bottom plate affixed to a bottom portion of said arm, a connecting plate extending the length of the outer surface of said arm, a pivot pin for pivotally attaching the arm-stiffening member to said housing, and a support clip that attached to a smooth area of said arm in a middle portion of said arm.

15. A PNEUMATICALLY-OPERATED ROBOTIC TOY comprising a housing; arms extending from said housing and including bellows means; air pump means located within said housing and communicating with said bellows means in said arms, wherein activation of said air pump causes elongation of said bellows means and movement of said arms from a first to a second position; and an arm-stiffening means affixed to said arms and including a bottom plate affixed to a bottom portion of said arm, a connecting plate extending the length of the outer surface of said arm, an upper support plate positioned between the arm and said housing and permitting rotational movement of said arm about its axis, and a support clip that attaches to a smooth area of said arm in a middle portion of said arm.

16. A PNEUMATICALLY-OPERATED ROBOTIC TOY according to claim 1, wherein said ari pump means is located within a head portion of said housing and movement of said head causes activation of said air pump means and movement of said arms.

* * * * *